US007765967B2

(12) United States Patent
Kira

(10) Patent No.: US 7,765,967 B2
(45) Date of Patent: Aug. 3, 2010

(54) VALVE TIMING CONTROL APPARATUS

(75) Inventor: Naoki Kira, Kariya (JP)

(73) Assignee: Aisin Seiki Kabushiki Kaisha, Kariya-Shi, Aichi (JP)

( * ) Notice: Subject to any disclaimer, the term of this patent is extended or adjusted under 35 U.S.C. 154(b) by 485 days.

(21) Appl. No.: 11/815,262

(22) PCT Filed: Feb. 10, 2006

(86) PCT No.: PCT/JP2006/302325

§ 371 (c)(1),
(2), (4) Date: Aug. 1, 2007

(87) PCT Pub. No.: WO2006/095532

PCT Pub. Date: Sep. 14, 2006

(65) Prior Publication Data

US 2009/0038568 A1 Feb. 12, 2009

(30) Foreign Application Priority Data

Mar. 11, 2005 (JP) ..... 2005-069001

(51) Int. Cl.
*F01L 1/34* (2006.01)

(52) U.S. Cl. ..... 123/90.17; 123/90.15; 464/160

(58) Field of Classification Search ..... 123/90.15, 123/90.16, 90.17, 90.18; 464/1, 2, 160
See application file for complete search history.

(56) References Cited

U.S. PATENT DOCUMENTS 5,715,780 A 2/1998 Haller
7,051,690 B2 * 5/2006 Dietz ..... 123/90.17
2004/0016414 A1 1/2004 Asari et al.
2005/0016482 A1 1/2005 Kobayashi et al.
2005/0274345 A1 12/2005 Dietz

FOREIGN PATENT DOCUMENTS

CN 1573029 A 2/2005
DE 102 60 546 A1 7/2004

(Continued)

OTHER PUBLICATIONS

Form PCT/ISA/210 (International Search Report) dated May 16, 2006.
Form PCT/ISA/237 (Written Opinion of the International Searching Authority) dated May 16, 2006.
European Search Report issued Jul. 20, 2009 in corresponding European Patent Application No. 06713468.4.

(Continued)

*Primary Examiner*—Ching Chang
(74) *Attorney, Agent, or Firm*—Buchanan Ingersoll & Rooney PC

(57) ABSTRACT

A valve timing control apparatus allows attachment of both a driven device and a valve timing control apparatus to one end of a cam shaft. The apparatus includes a drive member rotatable in synchronism with a crank shaft of an internal combustion engine, a driven member 4 disposed coaxially with the drive member and a fastener extending through the driven member from one axial end to the other axial end thereof. The fastener is fastened to a cam shaft of the internal combustion engine at the other axial end of the driven member, thereby fixing the driven member to the cam shaft. A rotation-transmitting groove is provided for attachment to a driven device The groove is integrally formed at one axial end of the fastener or in a member clamped in place by the fastener.

12 Claims, 6 Drawing Sheets

FOREIGN PATENT DOCUMENTS

| | | | |
|---|---|---|---|
| JP | 59-70828 | A | 4/1984 |
| JP | 2001-263025 | A | 9/2001 |
| JP | 2004-052708 | A | 2/2004 |
| JP | 2005-30310 | A | 2/2005 |
| JP | 2005-076482 | A | 3/2005 |
| WO | WO 2004/007916 | A1 | 1/2004 |

OTHER PUBLICATIONS

Official Action issued in CN Application No. 2006800078809, Sep. 12, 2008, State Intellectual Property Office of P.R.C.; and English-language translation thereof.

* cited by examiner

VALVE TIMING CONTROL APPARATUS

TECHNICAL FIELD

The present invention relates to a valve timing control apparatus including a driving rotational member rotatable in synchronism with a crank shaft of an internal combustion engine, a driven rotational member disposed coaxial relative to the driving rotational member, and a fastening member extending through the driven rotational member from one axial end to the other axial end thereof, the fastening member being fastened to a cam shaft of the internal combustion engine at the other axial end of the driven rotational member, thereby fixing the driven rotational member to the cam shaft.

BACKGROUND ART

In an internal combustion engine for e.g. an automobile, there sometimes is provided a valve timing control apparatus for controlling opening/closing timings of an intake valve or an exhaust valve, in accordance with driving conditions. This valve timing control apparatus is generally attached to one end of a cam shaft. Further, an auxiliary equipment such as a vacuum pump, a fuel pump, etc. is attached as a driven device driven by the internal combustion engine. These instruments sometimes are attached to one end of the cam shaft so as to reduce the total height of the internal combustion engine.

For instance, Patent Document 1 identified below discloses a construction for connecting a drive shaft of a driven device such as a fuel pump to one end of a cam shaft of an internal combustion engine. In this construction, a substantially cylindrical pump side coupling is attached with a nut to an end of the drive shaft located approximately at the center of the fuel pump. And, between a flange portion formed at one end of the cam shaft and the pump side coupling, there is interposed, as an intermediate member, a coupling constituting an Oldham's coupling, so that power is transmitted from the cam shaft and the drive shaft disposed substantially in series.

Patent Document 1: Japanese Patent Application "Kokai" No. 2001-263025 (page 3, FIGS. 1-3).

DISCLOSURE OF THE INVENTION

Problem To Be Solved By Invention

However, with the construction described in Patent Document 1 above, it is not possible to connect at one time both the driven device and the valve timing control apparatus to one end of the cam shaft. On the other hand, if the driven device is to be attached to one end of the cam shaft and the valve timing control apparatus is to be attached to the other end thereof, this results in increase in the total length of the internal combustion engine including the auxiliary equipment in the axial direction of the cam shaft, which leads to reduction in freedom of mounting to e.g. a vehicle.

On the other hand, as shown in FIG. 6 and FIG. 7, in a valve timing control apparatus 101 including an outer rotor 105 forming a sprocket 154 along the outer periphery thereof and rotatable in synchronism with a crank shaft (not shown) via a timing chain 121 entrained around the sprocket 154, an inner rotor 104 mounted inwardly and coaxially of the outer rotor 105 and fixed to an end of a cam shaft 103 by means of a bolt 107, and a cover plate 152 fixed to a face of the outer rotor 105 opposite to the face where the cam shaft 103 is disposed, the surface of the cover plate 152 can define engaging grooves 181 engageable with a coupling member 191 of a driven device 109, so that the driven device 109 may be rotatably driven with rotation of the outer rotor 105 of the valve timing control apparatus 101.

With the above-described construction, however, in order to ensure sufficient friction resistance of the engaging grooves 181, it is necessary to form the entire cover plate 152 of a material having high friction resistance, such as iron, sintered metal, or the like. This increases the weight of the valve timing control apparatus 101, hence increasing its inertia as well.

Further, with the above-described construction, the cover plate 152 is designed solely for the connection of the driven device 109. Accordingly, this construction cannot be used for a valve timing control apparatus 101 to which the driven device 109 is not attached. Thus, the construction is costly due to its low versatility.

The present invention has been made in view of the above problems. Its object is to provide a valve timing control apparatus which allows attachment of both a driven device and the valve timing control apparatus to one end of a cam shaft while restricting increase in the total length of an internal combustion engine in the axial direction of the cam shaft and which has high versatility and can restrict weight increase also.

Means to Solve the Problems

For accomplishing the above-noted object, according to a characterizing feature of a valve timing control apparatus to which the present invention pertains, the valve timing control apparatus comprises: a driving rotational member rotatable in synchronism with a crank shaft of an internal combustion engine, a driven rotational member disposed coaxial relative to the driving rotational member, a fastening member extending through the driven rotational member from one axial end to the other axial end thereof, the fastening member being fastened to a cam shaft of the internal combustion engine at the other axial end of the driven rotational member, thereby fixing the driven rotational member to the cam shaft and an engaging means disposed at one axial end relative to the driving rotational member and having an engaging groove for attachment of a driven device, said engaging means being integrally formed at one axial end of said fastening member.

With the above-described characterizing construction, it is possible to attach the driven device, via the engaging means, to one axial end of the valve timing control apparatus. Therefore, both the valve timing control apparatus and the driven device can be attached to one end of the cam shaft, while restricting increase in the total length of the internal combustion engine in the axial direction of the cam shaft.

Also, since the engaging means having an engaging groove is provided integrally at one axial end of the fastening member, it will suffice to form the fastening member alone of a material having high friction resistance. Hence, as a light-weight material can be used for the driving rotational member, it is possible to reduce the weight as well as the inertia, of the valve timing control apparatus.

Further, by selectively using the fastening member having the above-described engaging means for a valve timing control apparatus having a driven device attached thereto and using a standard fastening member for a valve timing control apparatus not having the driven device, it is possible to employ same components for most of the components of the valve timing control apparatus except for the fastening member. Therefore, it becomes possible to increase the versatility and to reduce the costs.

In the above, preferably, said engaging means includes a base portion formed at the one axial end of the fastening member and disposed at one axial end relative to said driving rotational member, and an engaging groove formed in one axial end face of said base portion along a straight line intersecting a rotational axis of the driving rotational member.

With the above, the engaging means having the engaging groove can be provided integrally at one axial end of the fastening member.

According to a further characterizing feature of the valve timing control apparatus to which the present invention pertains, the valve timing control apparatus comprises: a driving rotational member rotatable in synchronism with a crank shaft of an internal combustion engine, a driven rotational member disposed coaxial relative to the driving rotational member, a fastening member extending through the driven rotational member from one axial end to the other axial end thereof, the fastening member being fastened to a cam shaft of the internal combustion engine at the other axial end of the driven rotational member, thereby fixing the driven rotational member to the cam shaft and an engaging means disposed at one axial end relative to the driving rotational member and having an engaging groove for attachment of a driven device, said engaging means being clamped between one axial end of the fastening member and the driven rotational means.

With this characterizing construction, it is possible to attach the driven device, via the engaging means, to one axial end of the valve timing control apparatus. Therefore, both the valve timing control apparatus and the driven device can be attached to one end of the cam shaft, while restricting increase in the total length of the internal combustion engine in the axial direction of the cam shaft.

Also, since the engaging means having an engaging groove is clamped between one axial end of the fastening member and the driven rotational member, it will suffice to form the fastening member alone of a material having high friction resistance. Hence, as a light-weight material can be used for the driving rotational member, it is possible to reduce the weight as well as the inertia, of the valve timing control apparatus.

Moreover, by attaching the above-described engaging means to a valve timing control apparatus equipped with the driven device, but not attaching this engaging means to a valve timing control apparatus not equipped with the driven device, it is possible to employ common components for most components of the valve timing control apparatus. Therefore, the versatility can be increased and cost can be reduced.

In the above, preferably, said engaging means includes a base portion formed at the one axial end of the fastening member and disposed at one axial end relative to said driving rotational member, an engaging groove formed in one axial end face of said base portion along a straight line intersecting a rotational axis of the driving rotational member, an engaging portion to be engaged with an inner periphery of an insertion hole for the fastening member defined in the driven rotational member, and a further insertion hole for the fastening member defined on an inner radial side of said engaging portion.

With this, it is possible to provide an engaging means which can be fixed in position with good precision relative to the driven rotational member, when this engaging means is clamped between one axial end of the fastening member and the driven rotational member.

Further, said engaging means can constitute a portion of an Oldham's coupling.

With the above, even when there exists some displacement between a rotational shaft of the valve timing control apparatus and a rotational shaft of the driven device, this can be effectively absorbed by the Oldham's coupling, so that the valve timing control apparatus and the driven device can be connected under a favorable condition.

BEST MODE OF EMBODYING THE INVENTION

1. First Embodiment

Next, a first embodiment of the present invention will be described with reference to the accompanying drawings.

FIG. 1 is a vertical section showing a valve timing control apparatus 1 according to this embodiment. FIG. 2 is a front view of the valve timing control apparatus 1 according to this embodiment. FIG. 3 is a section taken along a line III-III in FIG. 1.

[Basic Construction]

As shown in FIGS. 1-3, the valve timing control apparatus 1 includes an outer rotor 5 as a driving rotational member rotatable in synchronism with a crank shaft (not shown) of an engine 2 as an internal combustion engine, and an inner rotor 4 disposed coaxially of the outer rotor 5 and acting as a driven rotational member fixed to a cam shaft 3.

The inner rotor 4 is integrally fixed to an end of the cam shaft 3 constituting a rotational shaft of a cam for controlling opening/closing of an intake valve or an exhaust valve. Specifically, as shown in FIG. 1, an engaging concave portion 41 formed, as an engaging portion, at the other axial end of the inner rotor 4 is engaged with an engaging convex portion 31 formed, as an engaged portion, at an end of the cam shaft 3. Then, under this condition, the inner rotor 4 is fixed as being fastened by a fastening member 7. More particularly, at the other axial end of the inner rotor 4, there is formed the engaging concave portion 41 as the engaging portion and at the one axial end of the inner rotor 4, there is formed a fixing hole 42 through which the fastening member 7 can extend.

On the other hand, at the end of the cam shaft 3, there are formed the engaging convex portion 31 as the engaged portion engageable with the engaging concave portion 41 of the inner rotor 4 and a contacting face 33 provided in the form of a stepped portion for this engaging convex portion 31. Further, at an axial portion of the cam shaft 3, there is formed a female threaded portion 34 to which the fastening member 7 can be threaded. Then, a face 43 of the rotor 4 on the other axial end thereof is brought into contact with the contacting face 33 of the cam shaft 3 and the engaging concave portion 41 will be engaged outwardly with the engaging convex portion 31. Under this condition, a male threaded portion 71 of the fastening member 7 will be threaded with the female threaded portion 34 of the cam shaft 3. With this, the inner rotor 4 is fixed to the end of the cam shaft 3.

The outer rotor 5 is engaged outwardly of the inner rotor 4 to be rotatable relative thereto with a predetermined rotational phase. And, a rear plate 51 is attached to the other axial face thereof to be connected with the cam shaft 3 and a cover plate 52 is attached to one axial face thereof opposite to the other axial end to which the cam shaft 3 is connected. In this embodiment, as shown in FIG. 1 and FIG. 2, the cover plate 52 includes a female threaded portion to be threaded with a bolt 53 as a fastening member. And, as this bolt 53 extends through the rear plate 51 and the outer rotor 5 to be threaded with the female threaded portion formed in the cover plate 52, the cover plate 52 and the rear plate 51 are integrally fixed to the outer rotor 5. Namely, in the instant embodiment, these members, i.e. the outer rotor 5, the cover plate 52 and rear plate 51 are driving rotational members rotatable together. Incidentally, these rear plate 51 and the cover plate 52 are disposed so as to respectively close openings of a fluid pressure chamber 61 to be described later, which is formed between the inner rotor 4 and the outer rotor 5 and open on opposed axial sides thereof.

Further, along the outer periphery of the outer rotor 5, there is integrally provided a timing sprocket 54. And, between this timing sprocket 54 of the outer rotor 5 and a crank sprocket fitted on a crank shaft of the engine 2, there is entrained a timing chain 21, whereby the outer rotor 5 is connected to be rotatable in unison with the crank shaft of the engine 2. That is, when the crank shaft of the engine 2 is rotatably driven, a rotational force is transmitted via the timing chain 21 to the timing sprocket 54. With this, the rotor 5 is driven to rotate along a rotational direction S shown in FIG. 3 and further the inner rotor 4 is driven to rotate along the rotational direction S, thus rotating the cam shaft 3. So that, the cam fitted on this cam shaft 3 pushes down and opens either the intake valve or the exhaust valve of the engine 2.

Further, as shown in FIG. 1, between the inner rotor 4 and the cover plate 52 fixed to the outer rotor 5, there is provided a torsion spring 64. Opposed ends of this torsion spring 64 are fixed respectively to a rotor side spring retaining portion formed as a circular groove in one axial end face 45 of the inner rotor 4 and a cover side spring retaining portion formed as a circular groove in a face of the cover plate 52 opposed to the inner rotor 4. And, this torsion spring 64 provides a torque for constantly urging the inner rotor 4 and the outer rotor 5 in a direction for displacing the relative rotational phase in a phase advancing direction S1.

[Construction of Hydraulic Operational Construction]

Next, a construction of a hydraulic operational mechanism of the valve timing control apparatus 1 relating to the present embodiment will be explained. As shown in FIG. 3, the outer rotor 5 includes a plurality of projections 55 projecting radially inward to act as shoes, the projections 55 being disposed slide by side and spaced apart from each other along the rotational direction. Between each adjacent pair of projections 55 of the outer rotor 5, there is formed a fluid pressure chamber 61 delimited by the outer rotor 5 and the inner rotor 4. In the illustrated example construction, there are provided five such oil pressure chambers 61.

Along the outer periphery of the inner rotor 4 and at portions thereof facing the respective oil pressure chambers 61 described above, there are formed grooves 44*a*, in which there are inserted vanes 44 for partitioning each oil pressure chamber 61 between a phase advanced angle chamber 61*a* and a phase retarded angle chamber 61*b* in the relative rotational direction (arrowed directions S1, S2 in FIG. 3). This vane 44 is urged toward radially outward side by means of a spring 44*b* provided on the radially inner side thereof, as shown in FIG. 1.

The phase advanced angle chamber 61*a* of the oil pressure chamber 61 is communicated with a phase advanced angle oil passage 62*a* formed in the inner rotor 4 whereas the phase retarded angle chamber 61*b* is communicated with a phase retarded angle oil passage 62*b* formed in the inner rotor 4. Further, these passages, i.e. the phase advanced angle oil passage 62*a* and the phase retarded angle oil chamber 62*b* are connected to an unillustrated hydraulic circuit. In operation, via a control valve, operational oil pumped by an oil pump is supplied to or discharged from one or both of the phase advanced angle chamber 61*a* and the phase retarded angle chamber 61*b*. With this, there is generated an urging force for displacing relative rotational phase between the inner rotor 4 and the outer rotor 5 (this will be referred to simply as "relative rotational phase" hereinafter) in the phase advancing direction S1 (the direction of displacing the vane 44 toward the side of the arrow S1 in FIG. 3) or the phase retarding direction S2 (the direction of displacing the vane 44 toward the side of the arrow S2 in FIG. 3) or maintaining it at a desired phase.

Further, between the outer rotor 5 an the inner rotor 4, there is provided a lock mechanism 63 capable of containing the displacement of the relative rotational phase between the inner rotor 4 and the outer rotor 5 to a predetermined locked phase (the phase shown in FIG. 3). This lock mechanism 63 includes a locking member 63*a* provided to be projectable radially inward from the outer rotor 5 and a concave locking chamber 63*b* provided in the outer periphery of the inner rotor 4. The locking chamber 63*b* is communicated with a locking passage 62*c* formed in the inner rotor 4, the locking passage 62*c* being communicated with the unillustrated hydraulic circuit.

The locking member 63*a* is guided by a guide groove 56 provided in the outer rotor 5 and slidable along the radial direction of the outer rotor 5. Further, the locking member 63*a* is urged radially inward by a spring 63*c*. In operation, as the locking member 63*a* projects into the locking chamber 63*b* formed in the outer periphery of the inner rotor 4, displacement of the relative rotational phase is prevented and contained to the locked phase. Here, this locked phase is set as such phase with which a smooth start of the engine can normally be obtained. In this case, the locking phase is set so as to correspond to the most phase retarded position of the relative rotational phase.

On the other hand, detachment of the locking member 63*a* from the locking chamber 63*b* is effected with supply of the operational oil from the unillustrated hydraulic circuit via the locking passage 62*c* into the locking chamber 63*b*. That is, as the operational oil is supplied to fill the locking chamber 63*b* and the force resulting from the pressure of this operational oil for urging the locking member 63*a* toward the radial outer side of the outer rotor 5 overcomes the urging force of the spring 63*c*, the locking member 63*a* is detached from the locking chamber 63*b*, whereby displacement of the relative rotational phase between the inner rotor 4 and the outer rotor 5 is allowed.

[Construction of Fastening Member]

In the valve timing control apparatus 1 relating to the present embodiment, as shown in FIG. 1, the fastening member 7 extends through the inner rotor 4 from its one axial end side to its other axial end side to be fastened to the cam shaft 3 at the axial other end of the inner rotor 4, thus fixing the inner rotor 4 to the cam shaft 3. Specifically, the fastening member 7 includes, at its other axial end, the male threaded portion 71 which can be threaded with the female threaded portion 34 of the cam shaft 3. Further, the fastening member 7 includes a head portion 72 formed on its one axial end side and an intermediate portion 73 interconnecting between this head portion 72 and the male threaded portion 71. The head portion 72 of the fastening member 7 is formed with a greater diameter than the male threaded portion 71 and the intermediate portion 73 and at the axis of the one axial end thereof, there is provided a tool engaging hole 74 (see FIG. 2) engageable with an unillustrated fastening tool. In this embodiment, this head portion 72 corresponds to what is referred to herein as "one axial end of the fastening member" in the present invention.

And, with this fastening member 7, the male threaded portion 71 and the intermediate portion 73 will be caused to extend through the fixing hole 42 formed in the inner rotor 4 and the male threaded portion 71 will be threaded with the female threaded portion 34 of the cam shaft 3. With these, the inner rotor 4 will be clamped between the head 72 of the fastening member 7 and the contacting face 33 of the cam shaft 3, whereby the rotor 4 is fixed to the cam shaft 3.

[Characterizing Construction Relating to Present Embodiment]

As shown in FIG. 1 and FIG. 2, in the present embodiment, at one axial end of the head portion 72 of the fastening member 7, there is integrally provided an engaging portion 8A as the engaging means 8. This engaging portion 8A is disposed on one axial end relative to the cover plate 52 and includes an engaging groove 81 for attaching a driven device. Specifically, the engaging portion 8A includes a disc-like base portion 82 formed at one axial end of the fastening member 7 and disposed on one axial end side relative to the cover plate 52 and an engaging groove 81 formed along the direction of diameter of the disc-like base portion 82. The disc-like base portion 82 is formed integrally by radially enlarging a portion of the one axial end portion of the head portion 72 of the fastening member 7. And, the other axial end face 82*a* of the disc-like base portion 82 is disposed in substantially parallel with the cover plate 52 with a predetermined spacing thereto to avoid contact therewith. And, the engaging groove 81 is a groove having a substantially square cross section which is open toward the one axial end face 82*b* of the disc-like base portion 82 and this is formed as a straight groove having a predetermined width (w) and extending along the diametric direction of the disc-like base portion 82. The width (w) of this engaging groove 81 is set as a width fitting with an engaging convex portion 92 of a coupling member 91 of the driven device 9 to be described later. Incidentally, around the tool engaging hole 74 provided at the axis portion of the disc-like base portion 82, there is formed a cylindrical concave portion 82*c* which is open on the one axial end face 82*b* side for receiving the fastening tool inserted therein.

And, the engaging groove 81 of the engaging portion 8A is engaged with the coupling member 91 fitted on an unillustrated drive shaft of the driven device 9. Examples of such driven device 9 driven by the engine 2 include various auxiliary equipments such as a vacuum pump, a fuel pump. The coupling member 91 of this driven device 9 includes an engaging convex portion 92 engageable with the engaging groove 81 of the engaging portion 8A. And, as this engaging convex portion 92 is engaged into the engaging groove 81 of the engaging portion 8A, the engaging portion 8A and the coupling member 91 are engaged with each other. Therefore, in this construction, the engaging convex portion 92 is formed as a ridge which has a square cross section matching with the engaging groove 81 and which is formed like a straight line having a predetermined width along the diametric direction of the coupling member 91.

Further, in the present embodiment, the engaging portion 8A constitutes a portion of an Oldham's coupling provided relative to the driven device 9. And, the engaging portion 8A, when engaged with the coupling member 91 constitutes the Oldham's coupling. Specifically, the coupling member 91 includes an intermediate member 94 having, as a projection, the engaging convex portion 92 on the other axial end side opposed to the engaging portion 8A of the fastening member 7 and having, as another projection, a second convex portion 93 on the one axial end side opposite thereto, and a driven device side member 96 defining a second concave groove 95 engageable with the second convex portion 93. In this, the second convex portion 93 formed in the intermediate member 94 is formed as a projection in the opposite direction to the engaging convex portion 92. And, the second convex portion 93 is formed like a straight line with a predetermined with along the diametric direction of the coupling member 91 normal to the engaging convex portion 92. Further, the second concave groove 95 is open on the one axial end side of the drive device side member 96 opposed to the second convex portion 93 to be engageable with this second convex portion 93.

2. Second Embodiment

Next, a second embodiment of the present invention will be described with reference to the accompanying drawings. FIG. 4 is a vertical section of a valve timing control apparatus 1 relating to this embodiment. FIG. 5 is a front view of the valve timing control apparatus 1 relating to this embodiment. As shown in these figures, in the valve timing control apparatus 1 relating to this embodiment, an engaging member 8B having an engaging groove 81 disposed on one axial end side relative to the cover plate 52 is clamped between the head portion 72 of the fastening member 7 and the inner rotor 4. In this respect, this embodiment differs from the first embodiment in which the engaging portion 8A is provided integrally with the fastening member 7. Next, the difference from the first embodiment will be described in details.

In this embodiment, the fastening member 7 has a shape similar to a standard bolt, without the engaging portion 8A formed therein. That is, the fastening member 7 includes a male threaded portion 71 formed at the other axial end side thereof to be threaded with the female threaded portion 34 of the cam shaft 3, a head portion 72 formed at one axial end side thereof, and an intermediate portion 73 interconnecting the head portion 72 and the male threaded portion 71. The head portion 72 of the fastening member 7 is formed with a greater diameter than the male threaded portion 71 and the intermediate portion 73 and at the axis of the one axial end thereof, there is provided a tool engaging hole 74 (see FIG. 5) engageable with an unillustrated fastening tool. And, the fastening member 7 extends through the inner rotor 4 from one axial end side to the other axial end side and is fastened to the cam shaft 3 at the other axial end side of the inner rotor 4. With this, the inner rotor 4 is clamped between the head portion 72 and the contacting face 33 of the cam shaft 3 via an engaging member 8B to be described later, thereby fixing the inner rotor 4 to the cam shaft 3.

The engaging portion 8B includes a disc-like base portion 82 disposed on one axial end side relative to the cover plate 52, an engaging groove 81 formed along the direction of diameter of the disc-like base portion 82, an engaging portion 83 engageable with an inner periphery of a fixing hole 42 defined in the inner rotor 4 for receiving the fastening member 7 inserted therethrough, and an insertion hole 84 for the fastening member 7 formed radially inward of the engaging portion 83.

In the above, the disc-like base portion 82 is disposed on one axial end side relative to the cover plate 52 and the other axial end face 82*a* of the disc-like base portion 82 is disposed in substantially parallel with the cover plate 52 with a predetermined spacing thereto to avoid contact therewith.

And, the engaging groove 81 is a groove having a substantially square cross section which is open toward the one axial end face 82*b* of the disc-like base portion 82 and this is formed as a straight groove having a predetermined width (w) and extending along the diametric direction of the disc-like base portion 82. The width (w) of this engaging groove 81 is set as a width fitting with an engaging convex portion 92 of a coupling member 91 of the driven device 9 to be described later.

On the other hand, at the other axial end side of the disc-like base portion 82, there are provided a contacting portion 85 having a contacting face 85*a* for coming into contact with the one axial end side face 45 of the inner rotor 4 and an engaging portion 83 which is formed to project from this contacting face 85*a* to the other axial end side and which is inserted into the fixing hole 42 formed in the inner rotor 4 to be engaged with the inner periphery of the fixing hole 42.

The contacting portion 85 and the disc-like base portion 82 are connected via a connecting portion 86.

At the axis portions of the disc-like base portion 82 and the connecting portion 86, there is formed a cylindrical concave portion 87 sized to be capable of receiving the head portion 72 of the fastening member 7. On the other hand, at the axis portion of the contacting portion 85 and the engaging portion 83, there is formed the insertion hole 84 sized to be capable of receiving the male threaded portion 71 and the intermediate portion 73 of the fastening member 7.

And, with this fastening member 7, the male threaded portion 71 and the intermediate portion 73 will be caused to extend through the fixing hole 42 formed in the inner rotor 4 and the male threaded portion 71 will be threaded with the female threaded portion 34 of the cam shaft 3. With these, the contacting portion 85 of the engaging member 8B will be clamped between the head portion 72 of the fastening member 7 and the one axial end side face 45 of the inner rotor 4, whereby the engaging member 8B is fixed to the inner rotor 4.

3. Other Embodiments (1) In the foregoing respective embodiments, the engaging groove 81 is constructed as a groove having a substantially square cross section and formed straight with the predetermined width (w) along the diametric direction of the disc-like base portion 82. However, the shape of the engaging groove 81 is not limited to such shape. Namely, the shape of the engaging groove 81 should fit the shape of the engaging convex portion 92 provided on the side of the driven device 9. Therefore, this can be a variety of shapes, depending on the shape of the engaging convex portion 92.

(2) In the foregoing respective embodiments, there have been described cases when the engaging portion 8A or the engaging member 8B as the engaging means 8 includes the disc-like base portion 82 and the engaging groove 81 formed along its diametric direction. However, the construction of the engaging means 8 relating to the present invention is not limited to such embodiments. That is, instead of the disc-like base portion 82, the base portion can have a variety of front shapes such as a polygonal shape such as a substantially rectangular shape, a substantially octagonal shape, etc. or an oval shape, etc. and the engaging groove 81 may be formed in one axial end side face of this base portion along a straight line intersecting its rotational axis. Such embodiment too is one preferred embodiment.

(3) In the foregoing respective embodiments, on the one axial end side of the outer rotor 5, there is provided the cover plate 52 and on the other axial end side thereof, there is provided the rear plate 51. And, the outer rotor 5, the cover plate 52 and the rear plate 51 constitute driving rotational members rotatable together. However, the cover plate 52 and the rear plate 51 are not necessarily provided, but can be formed integral with the outer rotor 5. Therefore, in such case, the engaging groove 81 of the engaging means 8 will be disposed on one axial end side of the outer rotor 5.

(4) In the foregoing respective embodiments, the timing chain 21 is employed as the power transmitting member to the outer rotor 5. However, in some cases, other power transmitting member such as a timing belt will be used.

DESCRIPTION OF REFERENCE MARKS

Figure 1:
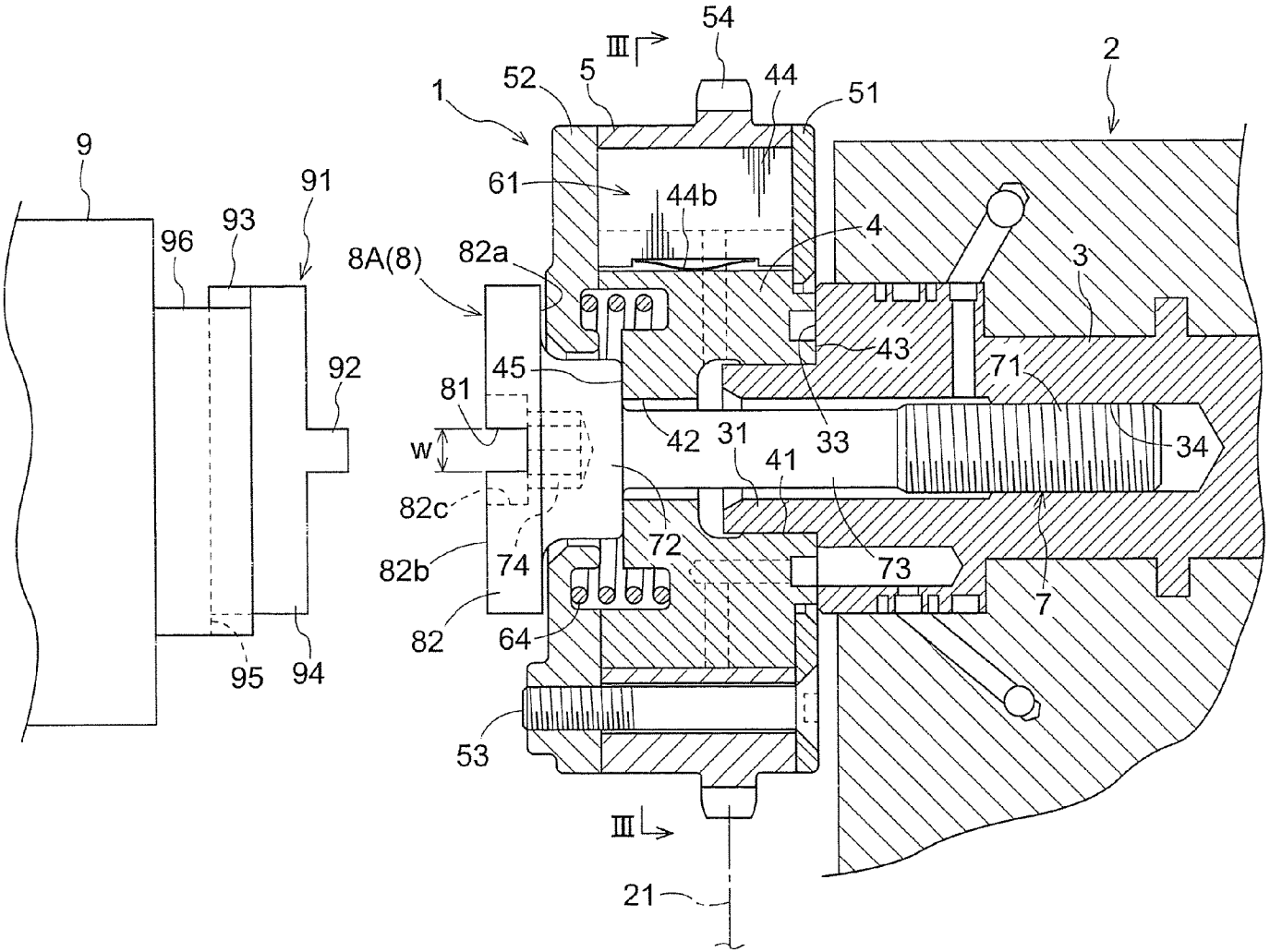
FIG. 1 a vertical section of a valve timing control apparatus according to a first embodiment of the present invention, FIG. 2 a front view of the valve timing control apparatus according to the first embodiment of the present invention, FIG. 3 a section taken along III-III in FIG. 1, FIG. 4 a vertical section of a valve timing control apparatus according to a second embodiment of the present invention, FIG. 5 a front view of the valve timing control apparatus according to the second embodiment of the present invention, FIG. 6 a vertical section of a valve timing control apparatus according to the background art, and FIG. 7 a front view of the valve timing control apparatus according to the background art.
Figure 2:
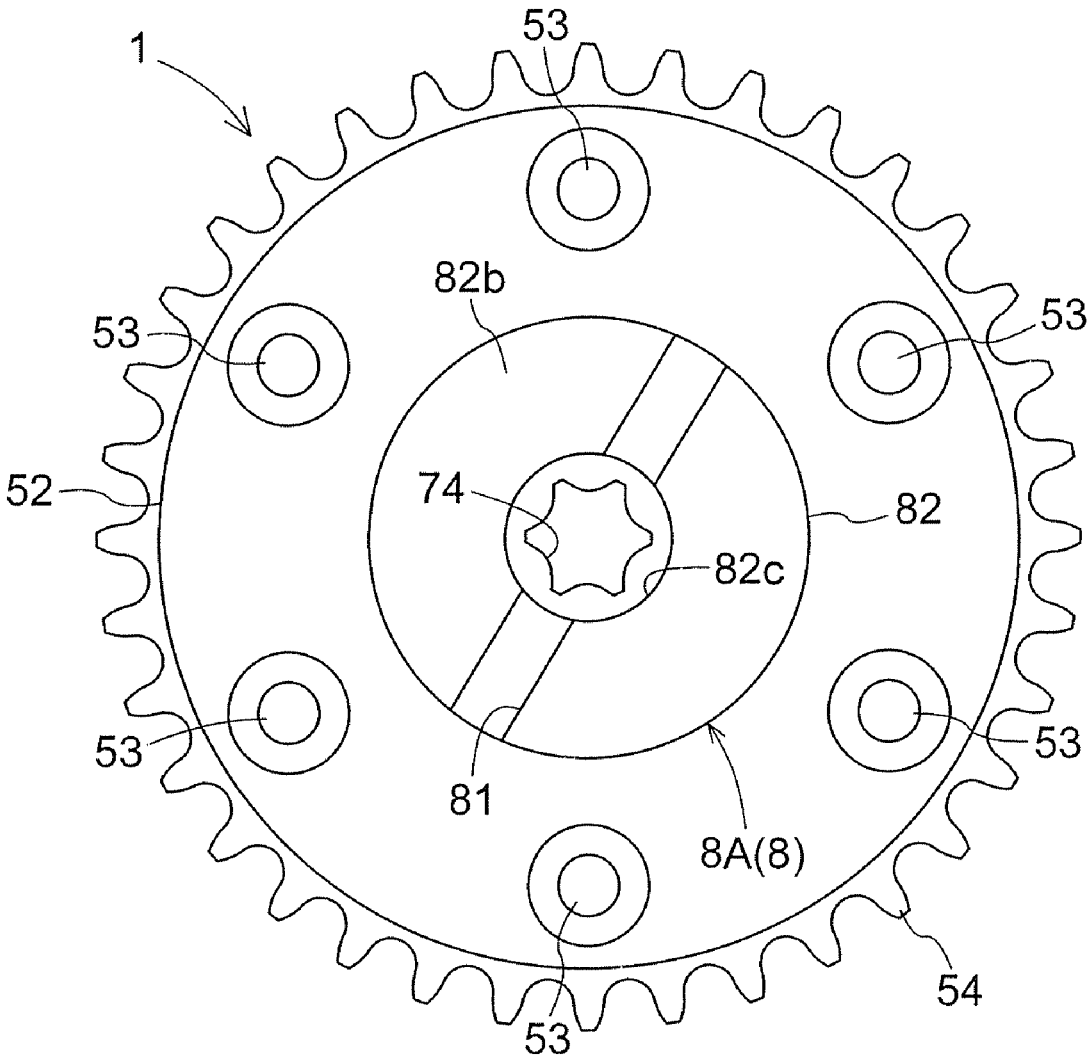
Figure 3:
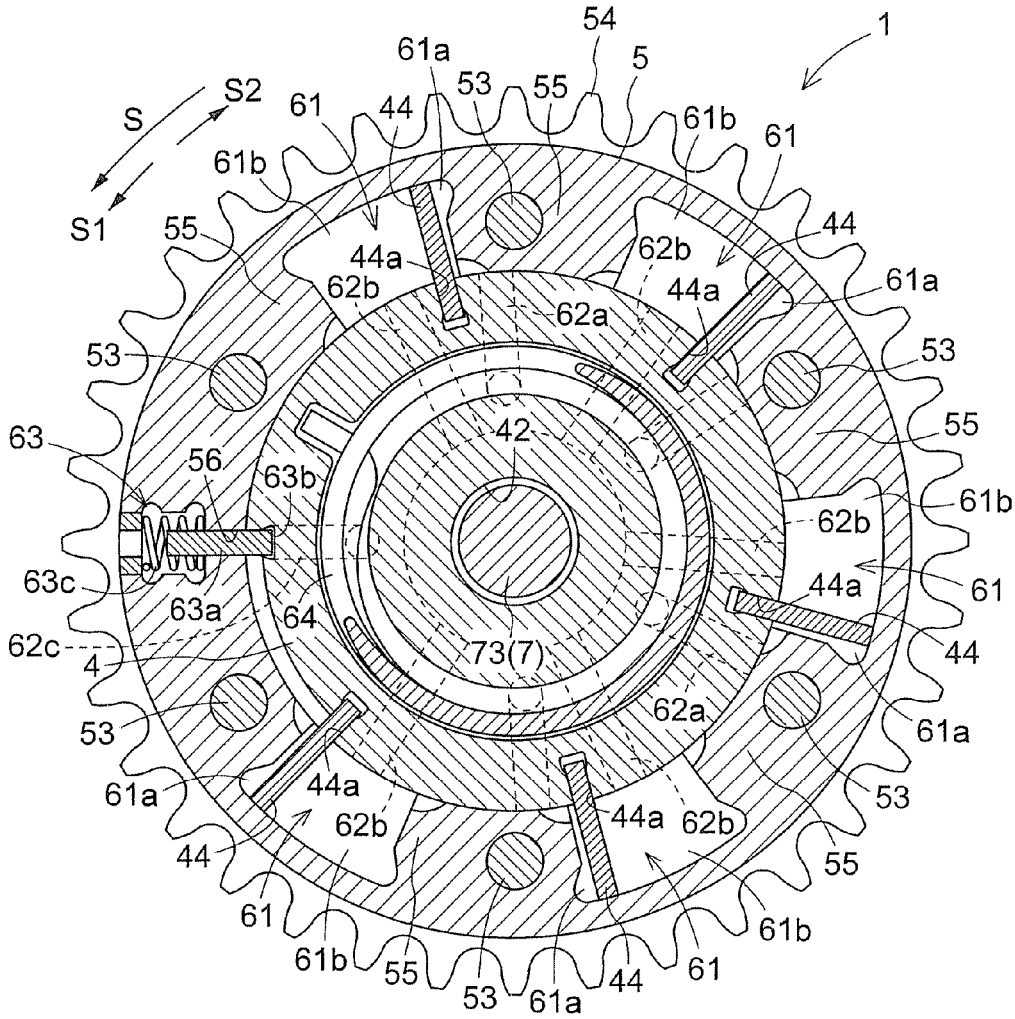
Figure 4:
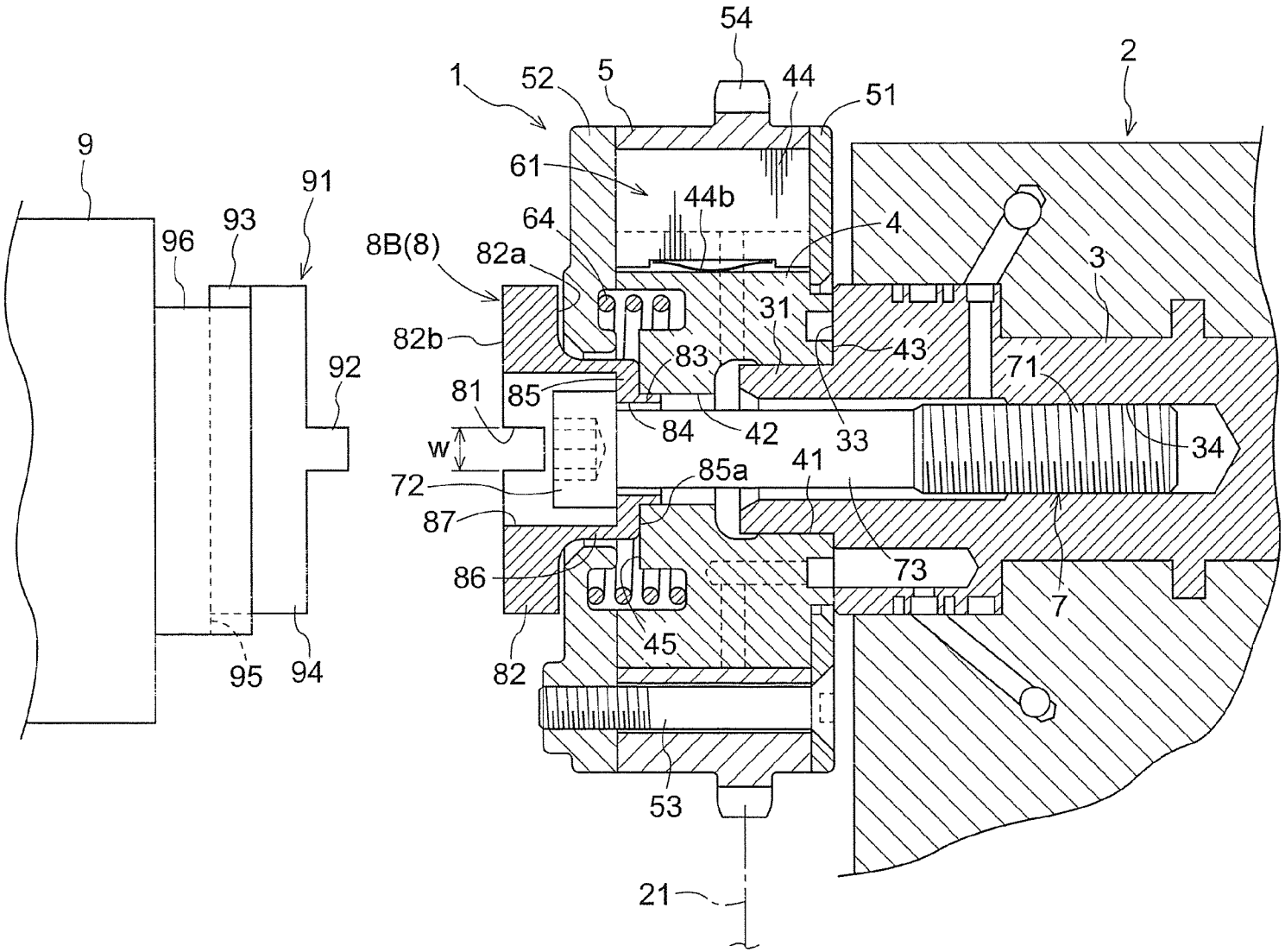
Figure 5:
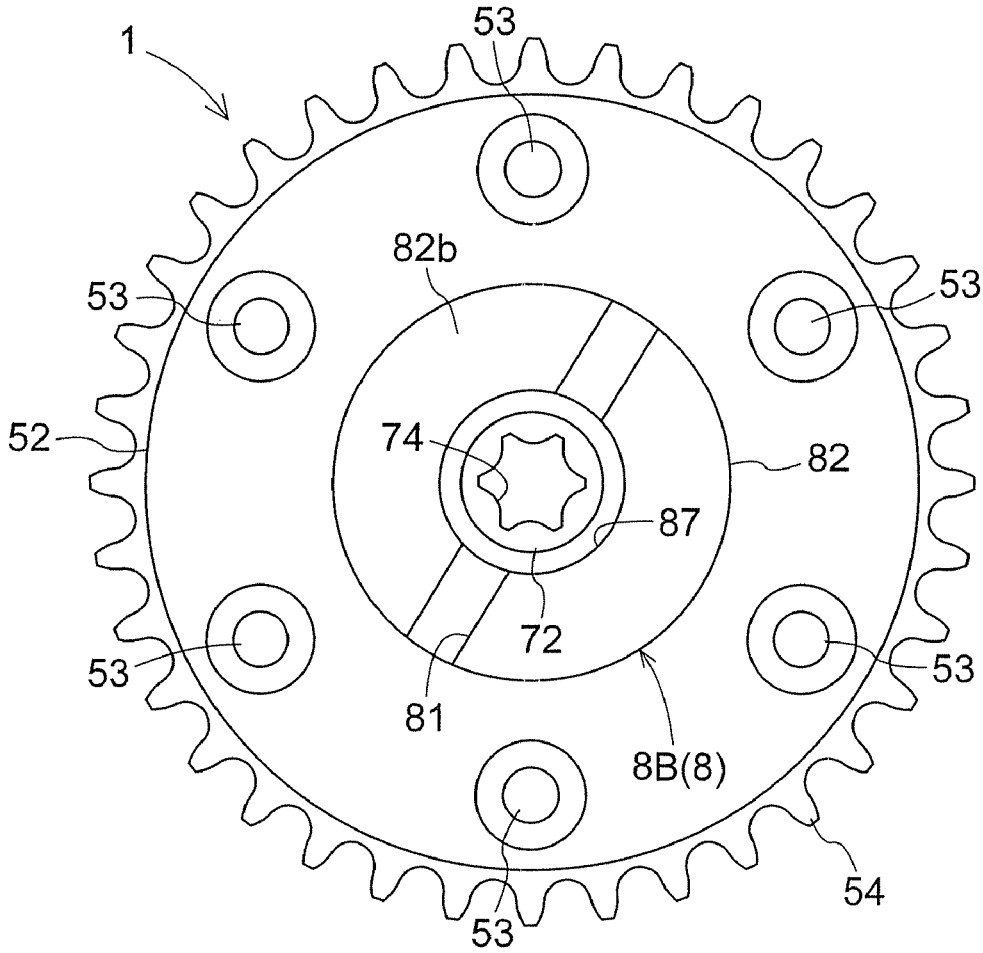
Figure 6:
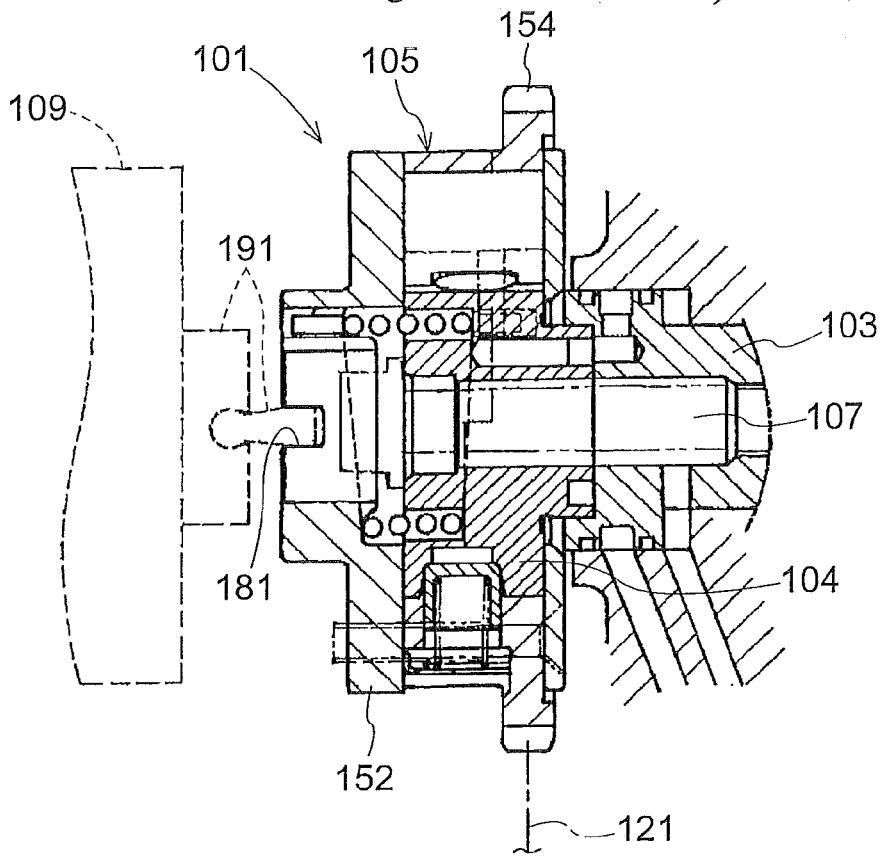
Fig.6 (PRIOR ART)
Figure 7:
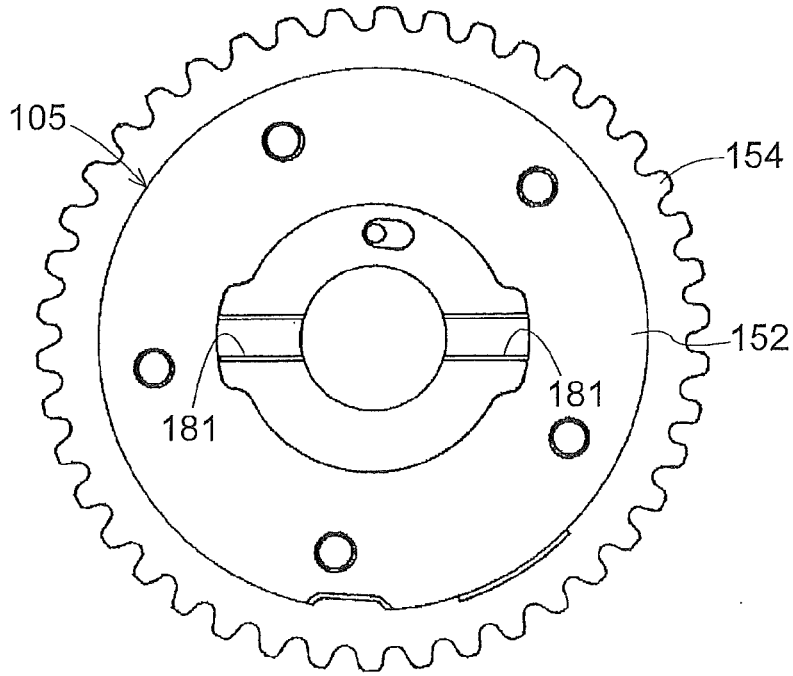
Fig.7 (PRIOR ART)

1: valve timing control apparatus
2: engine (internal combustion engine)
3: cam shaft
4: inner rotor (driven rotational member)
5: outer rotor (driving rotational member)
7: fastening member
8: engaging means
9: driven device
42: fixing hole (insertion hole for fastening member formed in the driven rotational member)
51: rear plate (driving rotational member)
52: cover plate (driving rotational member)
72: head portion (one axial side end of fastening member)
81: engaging groove
82: disc-like base portion (base portion)
83: engaging portion
84: insertion hole

The invention claimed is:

1. A valve timing control apparatus comprising:

a driving rotational member rotatable in synchronism with a crank shaft of an internal combustion engine;

a driven rotational member disposed coaxial relative to the driving rotational member;

a fastening member extending through the driven rotational member from one axial end to the other axial end thereof, the fastening member being fastened to a cam shaft of the internal combustion engine at the other axial end of the driven rotational member, thereby fixing the driven rotational member to the cam shaft; and an engaging member disposed adjacent one axial end of the driving rotational member and having an engaging groove adapted for attachment to a driven device, said engaging member being integrally formed on one axial end of said fastening member, wherein the engaging groove is configured to transmit rotational movement to a driven device about the axis.

2. The valve timing control apparatus according to claim 1, wherein said engaging member includes a base portion formed at the one axial end of the fastening member and disposed at one axial end relative to said driving rotational member, wherein the engaging groove is formed in one axial end face of said base portion along a straight line intersecting a rotational axis of the driving rotational member.

3. The valve timing control apparatus according to claim 2, wherein said engaging means comprising a portion of an Oldham's coupling.

4. The valve timing control apparatus according to claim 1, wherein said engaging means comprises a portion of an Oldham's coupling.

5. The valve timing control apparatus according to claim 1, wherein the driving rotational member and the driven rotational member are relatively rotatable about the axis to adjust their angular relationship.

6. The valve timing control apparatus according to claim 1, wherein the engaging groove has a rectangular cross section.

7. A valve timing control apparatus comprising:

a driving rotational member rotatable in synchronism with a crank shaft of an internal combustion engine;

a driven rotational member disposed coaxial relative to the driving rotational member;

a fastening member extending through the driven rotational member from one axial end to the other axial end thereof, the fastening member being fastened to a cam shaft of the internal combustion engine at the other axial end of the driven rotational member, thereby fixing the driven rotational member to the cam shaft; and an engaging member disposed adjacent one axial end relative of the driving rotational member and having an engaging groove adapted for attachment to a driven device, said engaging member being clamped between one axial end of the fastening member and the driven rotational member, wherein the engaging groove is configured to transmit rotational movement to a driven device about the axis.

8. The valve timing control apparatus according to claim 7, wherein said engaging means includes a base portion disposed at one axial end relative to said driving rotational member, and an engaging groove formed in one axial end face of said base portion along a straight line intersecting a rotational axis of the driving rotational member, and an engaging portion engageable with an inner periphery of a fixing hole defined in the driven rotational member for receiving the fastening member, and an insertion hole for the fastening member, the insertion hole being formed radially inward of the engaging portion.

9. The valve timing control apparatus according to claim 8, wherein said engaging means comprising a portion of an Oldham's coupling.

10. The valve timing control apparatus according to claim 7, wherein said engaging means comprising a portion of an Oldham's coupling.

11. The valve timing control apparatus according to claim 7, wherein the driving rotational member and the driven rotational member are relatively rotatable about the axis to adjust their angular relationship.

12. The valve timing control apparatus according to claim 7, wherein the engaging groove has a rectangular cross section.

* * * * *